US005238648A

United States Patent [19]

Kremen

[11] Patent Number: 5,238,648

[45] Date of Patent: Aug. 24, 1993

[54] HERMETIC ENCLOSURE ASSEMBLY FOR PRESERVATIONAL STORAGE AND/OR DISPLAY OF OTHERWISE DEGRADABLE OBJECTS

[76] Inventor: Irwin Kremen, 216 Forestwood Dr., Durham, N.C. 27707

[21] Appl. No.: 893,116

[22] Filed: Jun. 3, 1992

[51] Int. Cl.[5] ..... B01J 19/14

[52] U.S. Cl. ..... 422/40; 8/118; 8/119; 8/181; 8/196; 162/201; 206/45.19; 206/45.31; 206/459.1; 206/525; 422/291; 422/300; 422/305

[58] Field of Search ..... 422/40, 291, 300, 305; 8/181, 196, 118, 119; 162/201; 206/45.19, 45.14, 45.31, 204, 213.1, 424, 425, 459.1, 525

[56] References Cited

U.S. PATENT DOCUMENTS

| | | |
|---|---|---|
| 3,267,830 | 8/1966 | Van Gaasbeek . |
| 3,292,339 | 12/1966 | Esty . |
| 3,337,279 | 8/1967 | Reinhardt et al. . |
| 3,410,619 | 11/1968 | Delney et al. . |
| 3,703,353 | 11/1972 | Kusterer, Jr. et al. . |
| 3,943,987 | 3/1976 | Rossi . |
| 4,183,160 | 1/1990 | Brodersen . |
| 4,437,710 | 3/1984 | MacFarland et al. . |
| 4,548,824 | 10/1985 | Mitchell et al. . |
| 4,646,914 | 3/1987 | Gipson . |
| 4,927,497 | 5/1990 | Sharpe ..... 422/9 |

OTHER PUBLICATIONS

"Abbey Newsletter", by Chandru J. Shahani, Research Officer, Library of Congress, Apr. 1986.

Product Literature, Feb. 1, 1985 Nielsen® Metal Framing System, Nielsen Molding Design, P.O. Box 0534, Towsend, Mass. 01469.

*Primary Examiner*—Timothy M. McMahon

*Attorney, Agent, or Firm*—Steven J. Hultquist

[57] ABSTRACT

A hermetic enclosure assembly, having utility for preservational storage and/or display of objects susceptible to degradation by exposure conditions such as ultraviolet radiation, visible light, oxygen, humidity, microbial, fungal, and insect species, internal acidity and external acidic gases, and the like. The enclosure assembly includes a gas-impervious housing, a mounting base, and a back cover plate, with an oxygen indicating means in communication with an interior volume of the enclosure assembly, and a slow vapor-released deacidification medium being arranged for dispersing deacidification medium vapor into the interior volume of the enclosure assembly. Also disclosed is an appertaining method of preservationally and protectively enclosing an object for storage and/or display. The invention has particular utility in the storage and/or display of cellulosic objects, which are especially susceptible to embrittlement and decay at low pH conditions, in exposure to visible light, oxygen, and moisture.

20 Claims, 2 Drawing Sheets

HERMETIC ENCLOSURE ASSEMBLY FOR PRESERVATIONAL STORAGE AND/OR DISPLAY OF OTHERWISE DEGRADABLE OBJECTS

BACKGROUND OF THE INVENTION

1. Field of the Invention.

This invention relates to a hermetic enclosure assembly, having utility for preservational storage and/or display of objects susceptible to degradation by exposure conditions such as ultraviolet radiation, visible light, oxygen, humidity, microbial, fungal, and insect species, internal acidity and external acidic gases (internal acidity being intended here to mean the inherent acidity of the object itself, particularly where the object is of cellulosic composition), and the like, as well as to a method of preservationally and protectively enclosing an object for storage and/or display, wherein the object is of such degradation-susceptible type. This invention is particularly suitable for the storage and/or display of art objects, especially those made of paper, as well as historical documents of various types.

2. Description of the Related Art

Works of art, historical artifacts, and craft items, particularly those made of paper or other cellulosic materials, are susceptible to degradation and destruction by a variety of environmental pests and exposure conditions.

Ultraviolet radiation acts photochemically on polymeric materials and organic materials to degrade them, causing embrittlement of paper and cellulosic web materials, weakening of fabrics, and the bleaching of colors. Visible light energy, particularly in the range of from 400 to 500 nanometers, in the presence of and in interaction with oxygen, initiates photo-oxidation in cellulosic and other materials of construction which leads to their degradation and eventual destruction, in a cumulative fashion, with each instance or continuation of such exposure conditions adding to and promoting the cumulative degradation of the object. Humidity, apart from promoting curling and involutions in paper and other cellulosic materials, can contribute to the occurrence and propagation of mold, slime, and fungi, which may in turn disfigure cellulosic materials and disintegrate them. Paper and other cellulosic materials also are susceptible to attack by microbial species such as bacteria, and by insects that ingest paper. Further, atmospheric pollution can expose cellulosic objects to acidic contaminants which can progressively embrittle and disintegrate the cellulosic objects. In fact, many papers and documents of a valuable character are particularly susceptible to acidic decay as a consequence of paper manufacturing techniques which have been widespread since the middle of the last century, producing papers with internal (inherent) acidity.

Various attempts have been made in the art to develop a hermetically sealed device to frame art or to contain or encapsulate other kinds of valuable objects, as described, for example, in U.S. Pat. Nos. 3,292,339; 4,183,160; and 4,646,914. The deficiencies of the devices described in the first two identified patents are addressed in the third-mentioned patent, issued Mar. 3, 1987 to Jerome Gipson.

The Gipson patent describes an enclosure and mount for display of objects, e.g., works of art. The disclosed enclosure comprises a front plastic covering, mat board, mounting board, plastic foam backing having a desiccant disc therein and a final outside backing. The perimeter of this frame assembly is sealed by pressure-activated film tape after displacing air from the enclosure with inert gas. A moisture indicator is disposed within the enclosure for viewing through a window thereof.

The enclosure assembly described in the Gipson patent suffers the following disadvantages and deficiencies, in use:

1. The Gipson enclosure is assembled in such manner that even as the sealing tape is being applied to form the hermetic seal, the interior volume of the enclosure is being flushed by infusion of an inert gas. This represents a crude and awkward way of attempting to purge the interior volume of air, and provides no reliability as to the desired absence of oxygen from the purged interior volume. A final flushing of the interior volume of the enclosure, by puncturing the tape with a needle, with the tape being sealed again afterward, is not adequate to ensure the desired absence of oxygen in the interior volume. The moisture indicator arrangement of the Gipson enclosure is not adequate for sensing the presence of oxygen which when present creates the danger of interaction with light to cumulatively break down cellulosic fibers. Further, the final flushing of the Gipson assembly causes the enclosure to swell, and the surplus gas trapped within the enclosure is then forced out through the puncture hole by compressing the entire assembly between two sheets of plywood or plastic. This procedure creates a substantial risk of harm to any object mounted in the enclosure that is in any way fragile. The greater the pressure involved to achieve expulsion of surplus gas from the enclosure, the greater the risk of harm to the enclosed object. By way of example, brittle documents, pastels whose surface-lying pigments are intolerant of fixatives, collages of fragile papers with highly textured but tenuous surfaces, paintings the surfaces of which are crackled, and charcoal drawings that conservationally must avoid fixatives, to give but a few examples, could not be submitted to the conditions required by the Gipson patent, without engendering the risk of damage to or destruction of the enclosed object.

2. The Gipson assembly is primarily directed to control of humidity and prevention of atmospheric moisture from entering the interior. A desiccant, provided as an indicant of moisture, will undergo color change when the humidity enters the interior of the enclosure. It will also undergo color change when, in the normal course of affairs, humidity from the mounted object will be drawn via evaporation into the enclosure. Two undesirable occurrences would result: (i) a false positive indication might occur concerning the moisture contamination of the enclosure, requiring that the assembly be discarded or rebuilt, or (ii) the normal humidity associated with the object could in time become extracted from it, to the detriment of its structural integrity. This is particularly true of objects constructed of cellulosic materials which require some moisture content to retain structural integrity and properties.

3. The flexible sealing tape of the Gipson assembly will in time dry out and lose its efficacy as an hermetic seal.

4. The flexible sealing tape of the Gipson assembly is non-immune to penetration and damage by insects.

5. The back of the Gipson assembly is formed by a plate of foam core material containing a cavity for the desiccant. Such foam core material, however, readily loses its shape, and the back plate additionally is not itself isolated from humidity and the effects of atmospheric moisture. As a result, changes in the back plate moisture content and overall shape will cause stressing of the hermetic seal both at the periphery and at the seal associated with the cavity containing the desiccant. Such change in the shape of the back plate may also affect the mounting board, altering its shape from its original flatness to a curved or involuted shape, which can in turn place stress on the object mounted on the mounting board. These effects may be further compounded by the fact that the window plate, made of plastic or acrylic, will produce an electrostatic field that will exert an electrostatic force on the mounted object. Accordingly, a valuable art work or object mounted in the Gipson assembly potentially could be impacted by opposing forces involving the stress and strain behavior which could damage the mounted object and/or enclosure components over time, particularly if the objects are fragile or have tenuous surfaces.

6. Foam core is a flammable material of construction, and thus creates some risk of danger and harm to valuable art or documents mounted in such enclosure.

7. The Gipson frame does not provide UV filtering.

Accordingly, it would be a substantial advantage in the art of preservational storage and/or display of objects susceptible to degradation by exposure conditions such as ultraviolet radiation, visible light, oxygen, humidity, microbial, fungal, and insect species, internal acidity and external acidic gases, and the like, to provide a hermetic enclosure assembly overcoming the aforementioned deficiencies of the prior art.

It therefore is an object of the present invention to provide such a hermetic enclosure assembly, which is simple in construction, and readily assembled (and disassembled, if need be), which restricts the ingress of UV and other actinic radiation to the mounted object in the enclosure, which prevents the interaction of visible light and oxygen cumulatively to destroy polymeric materials, particularly the fibers of cellulosic objects, which effectively deacidifies any acidic mounted objects and establishes and maintains neutral pH conditions in the enclosure, and which does not dehydrate mounted objects to a point of embrittlement or decay, in the case of cellulosic objects such as paper.

It is another object of the invention to provide a method of preservationally and protectively enclosing an object for storage and/or display, which achieves the advantages and benefits stated in the preceding paragraph.

Other objects and advantages of the invention will be more fully apparent from the ensuing disclosure and appended claims.

SUMMARY OF THE INVENTION

In one aspect, the present invention relates to a hermetic enclosure assembly, having utility for preservational storage and/or display of objects susceptible to degradation exposure conditions such as ultraviolet radiation, visible light, oxygen, humidity, microbial, fungal, and insect species, internal acidity and external acidic gases, and the like, and comprising:

(a) a gas-impervious housing including a transparent front panel for viewing of an enclosed object, and side walls extending (i) rearwardly from the front panel and (ii) continuously about the perimeter of the front panel, the side walls at their rearward portions being interiorly recessed to accommodate flush-mounting of a back cover plate at the rearmost extremity of the side walls;

(b) a mounting base having a front main surface for mounting of an object thereon and a rear main surface, the mounting base permitting gas communication with an interior volume of the enclosure assembly bounded by the front panel, the front main surface of the mounting base, and associated portions of the side walls, with the mounting base being of a size and shape to fit interiorly of the housing;

(c) a back cover plate flush-mountably engaged with the interior recessed portion of the side walls, having first and second ports therein, and with selectively openable input and output valves therein for ingress of gas into the interior volume of the enclosure assembly and egress of gas therefrom, respectively;

(d) means for securing the mounting base in the interior volume;

(e) means for hermetically sealing the rearward portions of the side walls to the flush-mounted back cover plate;

(f) means for visually indicating the presence of an undesirable concentration of oxygen in the interior volume of the enclosure assembly, disposed in the first port of the back cover plate; and (g) a slow vapor-release deacidification medium disposed in the second port of the back cover plate and arranged for dispersing deacidification medium vapor into the interior volume of the enclosure assembly.

The mounting base in a preferred aspect may comprise a multi-layer structure with a front layer of cellulosic mounting stock secured to a rigid backing member. The rigid backing member may for example comprise an intermediate honeycomb plate secured to a rear metal plate, or a rear metal plate secured to an intermediate corrugated medium, or simply a rear metal plate alone, or a honeycomb plate alone. When the mounting base comprises gas-impervious material layers, it may in some instances be desirable to provide passage openings therein for gas communication with the interior volume of the enclosure assembly. Alternatively, the mounting base may be secured in the interior volume so as to allow such gas communication. In a particularly preferred embodiment, the mounting base comprises a cellulosic mounting stock secured to a rigid plate, and the rigid plate of the mounting base in turn is secured to the back cover plate of the enclosure assembly. The front main surface of the mounting base preferably is presented by a layer of gas-previous, substantially acid-free cellulosic mounting stock. Such cellulosic mounting stock may for example comprise a laminate of (i) multi-ply acid-free, archival quality, museum rag board, and (ii) single- or double-wall, acid-free, archival corrugated card board.

In a specific embodiment, the means for hermetically sealing the rearward portions of the side walls to the flush-mounted back cover plate may suitably comprise:

(i) mechanical fastener openings through the rearward portions of the side walls;

(ii) threaded holes in surfaces of the back cover plate abutting the side walls, and in register with the mechanical fastener openings through the side walls;

(iii) gasket sealing means disposed between the side walls and the back cover plate; and (iv) threaded mechanical fasteners extending through the mechanical fastener openings in the side walls and engaging the threaded holes in the back cover plate to compress the gasket sealing means between the side walls and the back cover plate for hermetic sealing of the enclosure assembly.

In another specific embodiment, the transparent front panel of the enclosure assembly may be formed of a material which substantially attenuates UV radiation exteriorly incident thereupon, e.g., the material of which the transparent front panel is formed may comprise a polymeric material containing a UV absorber component.

The means for securing the rigid plate of the mounting base to the back cover in the above-described assembly may suitably comprise:

(i) mechanical fastener openings through the back cover plate;

(ii) threaded cavities in the rigid plate of the mounting base; and (iii) mechanical fasteners adapted to pass through the mechanical fastener openings in the back cover plate and engage the threaded cavities in the rigid plate of the mounting base.

The means for visually indicating the presence of an undesirable concentration of oxygen in the interior volume of the enclosure assembly, may suitably comprise an electric lightbulb including a first filament in an evacuated gas-tight envelope, and a second, corresponding filament in gas communication with the interior volume of the enclosure assembly, wherein the two filaments are wired in series with leads extending exteriorly of the enclosure assembly for connection with an external power circuit means, and the first port includes a transparent port cover for visual observation of the two filaments, whereby current passed through the filaments from an external power circuit means will cause the second filament to light up in the presence of an undesirable concentration of oxygen in the interior volume of the enclosure assembly, but will light up the first filament in the absence of oxygen while the second filament remains inactive.

The vapor-release deacidification medium disposed in the second port of the back cover plate, as broadly described hereinabove, may suitably comprise hexamethylentetramine crystals, also known as methenamine and as hexamethylenamine, preferably in an amount to ensure the maintenance in the interior volume of the enclosure assembly of substantially neutral pH conditions.

In another aspect, the invention relates to a method of preservationally and protectively enclosing an object for storage and/or display, wherein the object is susceptible to degradation by exposure conditions such as ultraviolet radiation, visible light, oxygen, humidity, microbial, fungal, and insect species, internal acidity and external acidic gases, and the like, comprising the steps of:

(I) providing unassembled enclosure components comprising:

(a) a gas-impervious housing including a transparent front panel for viewing of an enclosed object, and side walls extending (i) rearwardly from the front panel and (ii) continuously about the perimeter of the front panel, the side walls at their rearward portions being interiorly recessed to accommodate flush-mounting of a back cover plate at the rearmost extremity of the side walls;

(b) a mounting base having a front main surface for mounting of the object thereon and a rear main surface permitting gas communication with an interior volume of the enclosure assembly bounded by the front panel, the front main surface of the mounting base, and associated portions of the side walls, with the mounting base being of a size and shape to fit interiorly of the housing;

(c) a back cover plate flush-mountably engageable with the interior recess portion of the side walls, having first and second ports therein and with selectively openable input and output valves therein for ingress of gas into the interior volume of the enclosure assembly and egress of gas therefrom, respectively;

(d) means for securing the mounting base in the interior volume;

(e) means for hermetically sealing the rearward portions of the side walls to the flush-mounted back cover plate;

(f) means for visually indicating the presence of an undesirable concentration of oxygen in the interior volume of the enclosure assembly, disposed in the first port of the back cover plate; and (g) a slow vapor-release deacidification medium disposed in the second port of the back cover plate and arranged for dispersing deacidification medium vapor into the interior volume of the enclosure assembly;

(II) mounting the object on the front main surface of the mounting base;

(III) assembling the components (a)–(g) to form the enclosure assembly;

(IV) opening the input and output valves in the back cover plate;

(V) mixing an inert gas with a vapor-phase deacidification component to form a multicomponent fill gas mixture;

(VI) flowing the multicomponent fill gas mixture through the input valve into the enclosure assembly to displace air and moisture therefrom through the output valve, for purging of the interior volume of the enclosure assembly; and (VII) closing the input and output valves.

Other aspects and embodiments of the invention will be more fully apparent from the ensuing disclosure and append claims.

DETAILED DESCRIPTION OF THE INVENTION, AND PREFERRED EMBODIMENTS THEREOF

Figure 1:
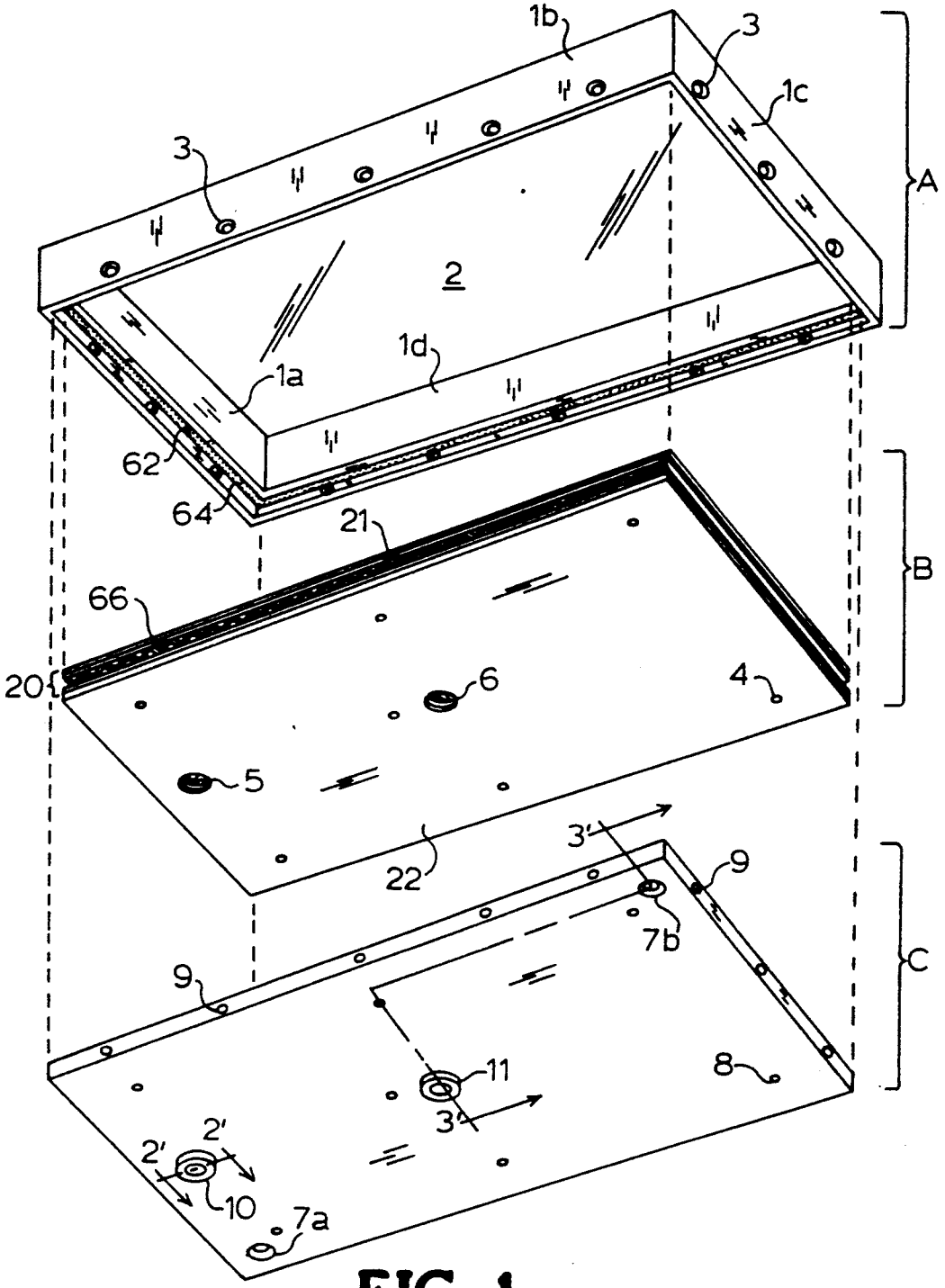
FIG. 1 is an exploded perspective view of a hermetic enclosure assembly, according to one embodiment of the present invention.

Referring now to the drawings, FIG. 1 shows a hermetic enclosure assembly according to the present invention, in one embodiment thereof.

The enclosure assembly comprises three main structural portions, a gas-impervious housing A, a mounting base B, and a back cover plate C.

The gas-impervious housing A includes a transparent front panel 2 for viewing of an enclosed object mounted on the mounting base B, and side walls 1*a*, 1*b*, 1*c*, and 1*d* which extend (i) rearwardly from the front panel 2 and (ii) continuously about the perimeter of the front panel 2. The side walls at their rearward portions are of recessed character, as more fully described hereinafter in connection with FIG. 3. Such interior recessed side wall structure accommodates flush-mounting of the back cover plate C at the rear-most extremity of side walls 1*a*, 1*b*, 1*c*, and 1*d*.

In a specific embodiment, the side walls 1*a*, 1*b*, 1*c*, and 1*d* may be of ¼ inch thickness along their non-recessed portions, and 1 inch in height, measured from the transparent from panel 2, although it will be recognized that the specific size, shape, and dimensions of the side walls and transparent front panel may be widely varied, depending on the specific size, shape, and character of the object to be mounted on the mounting base B for storage and/or display within the enclosure assembly.

The side walls may suitably be formed of any suitable gas-impervious material, such as for example acrylic or other polymeric material, e.g., the materials commercially available under the trademarks Plexiglas ®, Lucite ®, and Lexan ®, which provide a barrier to fluids, gases, insects, fungi, and other potential contaminants of the interior volume of the enclosure assembly.

It will be understood that the side walls may be integrally formed and of continuous character, or the wall segments 1*a*, 1*b*, 1*c*, and 1*d* may alternatively be discrete structural elements which are joined to one another to form the continuous side wall structure, by any suitable joining means and/or methods, such as solvent welding, ultrasonic bonding, thermal impulse sealing, mechanical fastening, adhesive bonding, etc., provided that the bonding means and/or methods involved yield a gas-impervious side wall structure. The bonding means and method should be selected so that no residual vapors from the bonding elements or bonding media can contaminate the interior volume of the enclosure assembly. Thus, in the case of adhesive bonding, a solvent-free bonding medium of negligible out-gassing character and negligible vapor pressure is desired. If a solvent-based bonding medium is employed, the same should be fully cured and, in its final cured state, be devoid of any significant vapor pressure, and devoid of any out-gassing tendency.

In like manner, the side wall structure may be integrally formed with the transparent front panel, being of a same material, or alternatively the transparent front panel may be joined to the side wall structure in any suitable manner, as for example by solvent welding, thermal impulse sealing, ultrasonic bonding, mechanical fastening, adhesive bonding, etc., subject to the same constraint of providing a gas-impervious character at the juncture of such members. The same considerations discussed in the preceding paragraph concerning residual vapor contamination and residual vapor pressure are applicable here.

In preferred practice, the transparent front panel of the gas-impervious housing A is advantageously formed of a material effective to attenuate ultraviolet (UV) and shorter wavelength radiation incident thereon. For example, the transparent front panel may be formed of a ⅛ inch thick panel of UV-filtering (UF-3) Lucite ® SAR acrylic material, which also is scratch-resistant and impervious to gas, fluids, insects, fungi, etc. As another example, the transparent front panel may be formed of Lexan ® polycarbonate containing a suitable UV absorber material, such as the UV absorber compounds and complexes commercially available from American Cyanamid Company (Wayne, N.J.) under the trademark Cyasorb ®. As further examples, the transparent front panel may be formed of Plexiglas ® UF-3 acrylic (Rohm & Haas Company, Philadelphia, Pa.), or alternatively of Acrylite OP-2, OP-3, or OP-3 P-99 acrylic materials, commercially available from CYRO Industries, Mt. Arlington, N.J.

Figure 3:
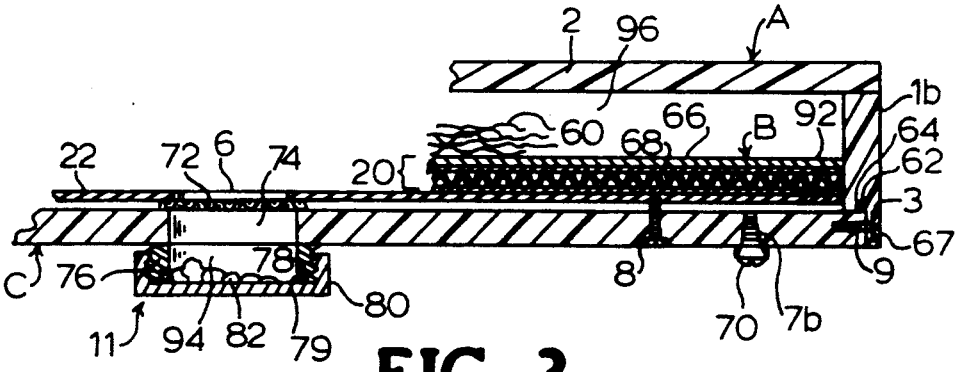
FIG. 3 is a cross-sectional, elevation view of the second port sub-assembly of the hermetic enclosure assembly of FIG. 1, together with an associated edge portion of the enclosure, showing the interior structure thereof.

As mentioned, the four side walls 1*a*, 1*b*, 1*c* and 1*d* are recessed to receive the back cover plate C and are grooved, as shown in FIG. 3 (side wall 1*b*) to receive an O-ring therein, to produce a hermetic seal at the juncture between the housing A and the back cover plate C.

At the upper portions of the side walls 1*a*, 1*b*, 1*c* and 1*d* as shown in FIG. 1, are provided a series of mechanical fastener openings (screw holes) 3 for passage therethrough of mechanical fasteners (screws) (not shown for clarity in FIG. 1) which corporately compress the O-ring disposed in the groove of the recess wall structure to produce a hermetic seal.

The mounting base B provides a structure upon which the object to be enclosed for storage and/or display purposes can be mounted and viewed through the transparent front panel. It will be recognized that in some instances where only a storage function is to be accommodated by the enclosure assembly, the front panel 2 may be of a non-transparent character, however it generally is preferred in practice to utilize a transparent material of construction for such element, to accommodate visual inspection of the enclosed contents even where the function is storage and not display.

The mounting base B has a front main surface for mounting of an object thereon and a rear main surface permitting gas communication with an interior volume of the enclosure assembly. The interior volume of the enclosure assembly is bounded by the front panel, the front main surface of the mounting base, and associated portions of the side walls, with the mounting base being of a size and shape to fit interiorly of the housing. The mounting base, as mentioned hereinabove, may comprise any suitable structural form, as for example a multi-layer laminate of a cellulosic mounting stock element providing the front main surface of the mounting base, secured to a rigid backing member, which may for example comprise a rigid metal plate, a rigid honeycomb structure, or a laminate of such rigid elements with an intermediate corrugated medium or other intermediate layer.

In the specific embodiment shown in FIG. 1, the mounting base B comprises a layer of gas-pervious, substantially acid-free cellulosic mounting stock 20 having a main front surface for mounting of an object thereon (not visible in FIG. 1, being the top surface of the mounting base structure in the orientation shown in that drawing), and having a rear main surface which is dry-mountingly or otherwise secured to a rigid plate 22 of gas-impervious material having a first passage opening 5 and a second passage opening 6 therein for gas communication with an interior volume of the enclosure assembly, bounded by the front panel 2, the mounting base main front surface (as indicated, the top surface in the orientation shown in FIG. 1), and associated portions of the side walls 1*a*, 1*b*, 1*c* and 1*d*, with the mounting base being of a size and shape to fit interiorly of the housing, and preferably in close-fit relationship to the bounding side walls of the enclosure assembly.

The mounting base B may suitably comprise a multiply, e.g., 4-ply, acid-free, archival quality, museum rag board, dry mounted to a single- or double-wall, acid-free, archival quality corrugated card board 21, as the cellulosic mounting stock 20, and a thin metal plate, e.g., a 1/16 inch thick aluminum plate, as the rigid plate 22 of the mounting base. The foregoing materials of construction are illustratively described, and it will be understood that the composition of the preferred mounting base components—the cellulosic mounting stock and the rigid plate—may be widely varied as to the form, structure, and composition of materials employed. It is preferred that the cellulosic mounting medium be acid-free and of archival quality, and that the rigid plate be of a gas-impervious character, of metal (such as aluminum), plastic, honeycomb material or composite material, or other suitable material of construction. A preferred honeycomb material is Hexcel® Blue Seal Sandwich Board honeycomb material, also known as Hexcel® Blue Seal Tooling Board honeycomb material, commercially available from Hexcel Corporation, San Francisco, Calif.

Tapped in the rigid plate 22 are threaded cavities 4 for receiving lock screws passed through the back cover plate C to secure the rigid plate of the mounting base to the back cover plate. In lieu of such mechanical fastening arrangement, any other suitable means for securing the rigid plate of the mounting base to the back cover plate may be employed, as for example welding, brazing, or other affixation means or method, however it is preferred to retain the back cover plate against the rigid plate of the mounting base by reversible mechanical fastening means such as threaded mechanical fasteners (screws) in order to facilitate the selective assembly and disassembly of the mounting base and back cover plate components, as desired. In this respect, it will be recognized that the back cover plate and the mounting base could be formed as a unitary laminated structure. Alternatively the rigid plate of the mounting base could be provided by the back cover plate, so that the cellulosic mounting stock is secured directly to the back cover plate in the absence of an intermediate rigid plate. The three-piece (A, B, C,) structure shown in FIG. 1 is highly preferred in practice, however, since it permits the enclosure to be used for a variety of mounted objects, with the mounting base and associated mounted object being selectively removable from the assembled enclosure assembly, to accommodate introduction therein of another mounted object on a different mounting base structure.

While the enclosure assembly has been described above as including the mounting base B being secured to the back cover plate C, it will be recognized that the mounting base may be otherwise secured in the interior volume of the enclosure assembly. For example, it may be feasible in some instances to direct affix the mounting base to one or more of the side walls of the enclosure assembly, or otherwise to secure the mounting base within the enclosure assembly interior volume.

Referring again to the drawings, the first passage opening 5 in mounting base B permits gas communication of such opening with the interior volume of the assembled enclosure assembly. Such arrangement accommodates the operation of means for visually indicating the presence of an undesirable concentration of oxygen in such interior volume of the enclosure assembly. The indicating means are disposed in first port 10 of the back cover plate C, with which first passage opening 5 is in register when the assembly is fully assembled.

In like manner, second passage opening 6 provides gas communication with the interior volume of the enclosure assembly and is arranged to be in registration with second port 11. When the enclosure assembly is fully assembled, the second port accommodates a slow vapor-release deacidification medium disposed therein for dispersing deacidification medium vapor into the interior volume of the enclosure assembly, as hereinafter more fully described.

The back cover plate may be formed of any suitable material of construction, as for example a plate of any of the aforementioned acrylic, polymeric, or other (e.g., metal, etc.) materials. In a preferred embodiment, the back cover plate may be ¼ inch in thickness and formed of Plexiglas® acrylic sheet. A number of threaded mechanical fastener openings (screw holes) 8 are provided in the back cover plate, in registration with the threaded cavities 4 of the rigid plate of the mounting base B. Diagonally opposite one another on the back cover plate are valve openings 7*a* and 7*b*, which communicate to the interior volume directly. These valve openings 7*a* and 7*b* are adapted to receive respective input and output valves, for introduction of gas into the enclosure assembly (opening 7*a*) and for discharging gas from the enclosure assembly (opening 7*b*). The associated valves (not shown) may be of any suitable type which are usefully employed for purging of air from the enclosure and introduction thereinto of an inert or otherwise non-oxidizing gas.

In a specific embodiment, valve openings 7*a* and 7*b* may be tapped and of a size to receive 10–32 pan head screws ¼ inch in length therein, which in turn receive the input and output valves, respectively. In this embodiment, 4–40 pan head screws ⅜ inch in length may be threadably received in openings 8, such screws locking the mounting base to the back cover plate, and 3–48 flat head screws 5/16 inch in length may be passed through the mechanical fastener openings 3 in the side walls 1*a*, 1*b*, 1*c*, and 1*d* to be engaged in the threaded holes 9 in the back cover plate.

Figure 2:
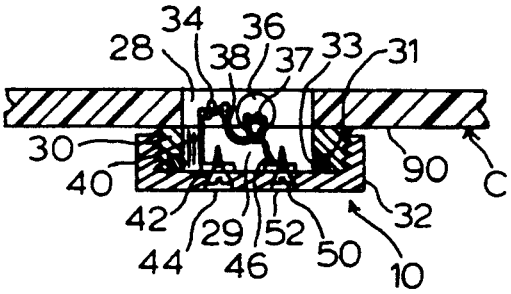
FIG. 2 is a cross-sectional, elevation view of the first port sub-assembly of the hermetic enclosure assembly of FIG. 1, comprising means for visually indicating the presence of an undesirable concentration of oxygen in the interior volume of the assembly.

FIG. 2 shows a cross-sectional, elevation view of the first port 10 of the back cover plate C. An opening 28 is provided therein, which on the exterior side 90 of the back cover plate communicates with an extension volume 29 bounded by the outwardly extending extension wall 30 which is threaded on its exterior side surface for mateable engagement with a cooperatively threaded port cap 32, which thus threadably engages the extension wall 30. The extension wall 30 on its upper interior portion is formed with a recess 31 in which is disposed an O-ring 33 which is compressively engaged by the extension wall 30 and the port cap 32 to provide a hermetic seal at port 10. Disposed in the space formed by opening 28 and extension volume 29 is a filament 34 which is joined in series with lightbulb 36 containing a corresponding filament 37, the filament 34 and bulb 36 being interconnected by wire 38. Exposed filament 34 also is joined by wire 40 to external terminal screw 42 threadably reposed in opening 44 of the port cap 32. Correspondingly, bulb 36 containing filament 37 is joined by wire 46 to a second external terminal screw 50 threadably reposed in port cap opening 52. The port cap 32 is transparent over its main surface overlying filament 34 and bulb 36. Bulb 36 is suitably sized, e.g., a 2.5 volt bulb, and the exposed filament 34, of a same material of construction, e.g., tungsten, may be rated at a voltage rating of 1.5 volts. Filament 34 is smaller than filament 37 in order to act as a fuse and hence serve as an oxygen detector. Where filament 34 is bare, filament 37 is encased in evacuated bulb 36.

The external terminal screws 42 and 50 may suitably comprise 0–80 flat head screws ¼ inch in length.

While the filament 34, bulb 36 and associated wiring have been shown schematically in FIG. 2 as devoid of any support or containment structure other than the extension wall 30 and port cap 32, it will be recognized that the filament and bulb and associated wiring may be provided in a unitary structural sub-assembly, as for example in a cylindrical capsule which is inserted and retained in such unitary form in port 10.

The opening 28 in back cover plate C is, as mentioned, in register with first port opening 5 in the rigid plate 22 of mounting base B, and the filament 34 and bulb 36 therefore are in gas communication with the enclosure volume defined by the transparent front panel 2, the mounting base B and side walls 1*a*, 1*b*, 1*c* and 1*d*.

When fully assembled, the enclosure assembly shown in FIG. 1 is hermetically sealed, and in the absence of oxygen, a current passed through the circuit shown in FIG. 2 will cause bulb 36 to illuminate, but filament 34 will not glow or otherwise provide illumination, since oxygen is required for such illumination to occur. If, however, an undesirable concentration of oxygen is present in the interior volume of the enclosure assembly, the filament 34 will burn (glow) and thereby visually evidence the presence of an undesirable concentration of oxygen in the interior volume of the enclosure assembly. The bulb 36 comprising filament 37 thus provides a "control" evidencing passage of current through the circuit comprising filament 34, bulb 36 and associated wires 40, 38, and 46. The circuit may be activated for testing of the interior volume gas for the presence of oxygen, by attachment of a battery, e.g., a "C"-size battery, by suitable leads or contacts to the external terminal screws 42 and 50. Alternatively, an ohm-meter set at a suitable resistance level, such as 1000 ohms, may be employed in contact with the terminal screws 42 and 50. A positive deflection of the ohm-meter needle proves intactness of the circuit, which would not be the case if oxygen were present in the interior volume, since in that case the exposed filament 34 would burn (glow).

The port assembly shown in FIG. 2, comprising means for visually indicating the presence of an undesirable concentration of oxygen, thus represents a preferred embodiment of the invention, it being understood that other means for indicating the presence of undesirable concentrations of oxygen in the interior volume of the enclosure assembly may alternatively be employed, which do not require visual observation or visual verification of elements disposed in the port. For example, it may be feasible in some instances to provide an oxygen sensing apparatus which utilizes a surface acoustic wave (SAW) oxygen sensor or other means providing output at the port, such as a computer-compatible data port device joined to the SAW unit or other sensor device.

FIG. 3 shows a cross-sectional, elevation view of a portion of the assembled enclosure assembly of FIG. 1, showing the details of construction thereof, including the second port 11.

As shown in FIG. 3, the gas-impervious housing A comprises the front panel 2 joined at an edge extremity thereof to side wall 1B. The side wall is provided with a recessed groove 62 in its outer portion (such portion being denoted as "outer" in relation to the junction of the side wall with front panel 2). Disposed in the groove 62 which extends around the full perimeter of the respective side walls 1*a*, 1*b*, 1*c* and 1*d* at their grooved recess-containing portions, is an O-ring 64 which may, for example, be comprised of a 0.07 inch diameter silastic rubber gasket.

At its outer extremity (again in reference to front panel 2), a mechanical fastener (screw) 67 extends through mechanical fastener opening 3 (housing A) in the side wall and engages threaded opening 9 in back cover plate C.

Reposed in threaded opening 7*b* of back cover plate C is a 10–32 pan head screw 70 receiving an output valve for evacuation of the interior volume of the enclosure assembly, it being understood that opening 7*a* of the back cover plate similarly receives a corresponding fastener element accommodating connection with an input valve to introduce gas into the interior volume of the enclosure assembly.

The mounting base B includes cellulosic mounting stock 20 comprising a laminate of multi-ply acid-free, archival quality, museum rag board 66 dry-mounted to single- or double-wall, acid-free, archival quality corrugated cardboard 68. On the front main surface 92 of the cellulosic mounting stock 20 is mounted a 3-dimensional paper collage 60, which may be viewed through the transparent front panel 2 of the enclosure assembly, when the assembly is exhibited or otherwise employed for observation of the mounted object 60.

The back cover plate C has an opening 74 therein which is circumscribed by extension wall 76. Extension wall 76 is threaded on its exterior surface for matingly engaging a port cap 80, as shown. The extension wall 76 is constructed similarly to extension wall 30 of first port 10 shown in FIG. 2, with a recess 78 in its outer portion accommodating therein a gasket element 79, such as an O-ring. The extension space 94 bounded by the extension wall 76 thus provides with opening 74 a passage which is in gas communication with the interior volume of the enclosure assembly. Reposed between opening 74 and rigid plate 22 of mounting base C, is a screen or mesh element 72, which is secured to back cover plate C in any suitable manner. The screen or mesh element 72 is of a suitable mesh size to retain (in the port volume formed by space 94 and opening 74) a desired quantity of a slow-vapor release deacidification medium 82, which releases deacidification medium vapor into the interior volume of the enclosure assembly by passage through opening 74, screen or mesh element 72, an opening in rigid plate 22, and through the cellulosic mounting stock 20 of mounting base B to the interior volume 96. (The oxygen indicating means shown in FIG. 2 communicates with the interior volume of the enclosure assembly, through the mounting base, in a similar fashion).

The deacidification medium 82 disposed in space 94 and opening 74 may suitably comprise granular or particulate crystals of hexamethylentetramine (also known as methenamine and as hexamethylenamine), in an amount sufficient to ensure the maintenance of the interior volume of the enclosure assembly, of substantially neutral pH conditions. The use of vapor for gaseous diffusion paper deacidification of large quantities of books simultaneously, is described in U.S. Pat. No. 3,703,353, the disclosure of which hereby is incorporated herein by reference.

The mesh size of screen or mesh element 72 is of sufficient dimensional character to retain the particulate or granular crystals of hexamethylentetramine in the volume comprising space 94 and opening 74, while allowing free diffusional passage of the deacidification vapor into the interior volume of the enclosure assembly.

In place of hexamethylentetramine crystals, and other suitable vapor-release deacidification medium may be disposed in the second port of the back cover plate, for dispersing deacidification medium vapor into the interior volume of the enclosure assembly, thereby assuring long life for cellulosic mounted objects, as well as the cellulosic components of the mounting base, in a neutral pH, deacidified condition.

Although again shown schematically in FIG. 3, it will be understood that the vapor-release deacidification medium may be introduced in a capsulized or other "packaged" form whereby the vaporization component may be provided in gas communication with the interior volume of the enclosure assembly.

In a specific embodiment comprising a frame of 12 inch by 16 inch by 1 inch dimensions, approximately 1 cubic centimeter of hexamethylentetramine crystals may be employed to provide a long-term, neutral pH condition in the enclosure assembly, providing hexamethylentetramine vapor is mixed in with an inert gas to form a multicomponent gas mixture for the interior volume.

In the event that the oxygen indicating means disposed in the first port of the back cover plate evidences the presence of undesirable concentrations of oxygen, the enclosure assembly through its respective valve ports *7a* and *7b* may be purged of the gas present in the interior volume, with same being displaced and replaced by suitable oxygen-free gas. Thus, the input valve port *7a* may be coupled with suitable plastic tubing joined in turn to a source of a suitable non-oxidizing, preferably inert, gas, such as nitrogen, argon, or the like. Gas may then be introduced through valve port *7a* with port *7b* concurrently being open and gas being flushed from the interior volume therethrough to the exterior environment. Following the displacement of the undesired gas from the interior volume, valve port *7a* and *7b* can again be closed, and the enclosure assembly returned to its storage and/or display function.

In practice, sufficient space should be provided between the mounted object 60 and the front panel 2, to avoid the pressure and force effects discussed hereinabove in the "Background of the Invention" section hereof.

When first assembled, by the method as broadly described in the "Summary of the Invention" section hereof, the enclosure assembly may be connected by valve port *7a* and suitable connecting tubing to a chamber (not shown) containing a small heating device or furnace, for the purpose of incorporating a vaporizable deacidification medium, which may be hexamethylentetramine (or other deacidification medium which alternatively may be disposed in the second port of the back cover plate). Such chamber, in turn, may be connected by connecting tubing to a gas tank filled with non-oxidizing gas, such as for example nitrogen, or argon. The inert carrier gas is allowed to flow from the tank to the chamber to mix with the vapor of the vaporized deacidification medium, and the resulting multicomponent gas mixture is fed through the connecting tubing and through valve port *7a* into the interior volume of the enclosure assembly. Using as an example an enclosure assembly measuring 12 inches by 16 inches by 1 inch, three sequential flushings of the interior volume gas space may be carried out, and three enclosure assembly units can be serviced simultaneously, wherein one cubic centimeter of hexamethylentetramine crystals is placed in the furnace of the mixing chamber and the flow rate of nitrogen carrier gas is 2 cubic feet per hour, with each enclosure assembly being flushed for a total of 7 minutes. As the influent multicomponent gas mixture is introduced through valve port *7a*, the preexisting gas from the interior volume of the enclosure assembly is displaced and discharged through valve port *7b* of the assembly.

For display or exhibition purposes, any suitable frame or mounting, in wood, metal, or plastic, can be placed around the enclosure assembly, as a decorative or aesthetic border to hide the marks of facture that otherwise would be observable. The moudling may preferably comprise Nielsen Moulding Design Metal Moulding No. 22 whose channel is exactly one inch and fits the model herein described.

In addition to the specific features and embodiments described, it will be recognized that additional sorbent materials may be employed in the interior volume of the enclosure assembly, as for example oxygen gettering materials, which chemisorb oxygen and form reaction products of negligible vapor pressure. Further, in addition to the rectangular form of the enclosure assembly illustratively shown and described with reference to FIGS. 1-3 hereof, it will be recognized that the shape of the enclosure assembly may be widely varied, e.g., including circular, oblate, polygonal, and irregular shapes, and that the size and dimensions of the enclosure assembly may be widely varied.

Accordingly, while the invention has been described with reference to specific features, embodiments, and modifications, it will be appreciated that numerous other variations, modifications, and embodiments are possible, and accordingly, all such variations, modifications, and embodiments are to be regarded as being within the spirit and scope of the invention.

What is claimed is:

1. A hermetic enclosure assembly, comprising:

(a) a gas-impervious housing including a transparent front panel for viewing of an enclosed object, and side walls extending (i) rearwardly from the front panel and (ii) continuously about the perimeter of the front panel, the side walls at their rearward portions being interiorly recessed to accommodate flush-mounting of a back cover plate at the rearmost extremity of the side walls;

(b) a mounting base having a front main surface for mounting of an object thereon and a rear main surface, said mounting base permitting gas communication with an interior volume of the enclosure assembly bounded by the front panel, the front main surface of the mounting base, and associated portions of the side walls, with the mounting base being of a size and shape to fit interiorly of the housing;

(c) a back cover plate flush-mountably engaged with the interior recess portion of the side walls, having first and second ports therein, and having selectively openable input and output valves therein for ingress of gas into the interior volume of the enclosure assembly and egress of gas therefrom, respectively;

(d) means for securing the mounting base in the interior volume;

(e) means for hermetically sealing the rearward portions of the side walls to the flush-mounted back cover plate;

(f) means for visually indicating the presence of oxygen in the interior volume of the enclosure assembly, disposed in the first port of the back cover plate; and (g) a vapor-release deacidification medium disposed in the second port of the back cover plate and arranged for dispersing deacidification medium vapor into the interior volume of the enclosure assembly.

2. A hermetic enclosure assembly according to claim 1, wherein the means for hermetically sealing the rearward portions of the side walls to the flush-mounted back cover plate comprise:

(i) mechanical fastener openings through the rearward portions of the side walls;

(ii) threaded holes in surfaces of the back cover plate abutting the side walls, and in register with the mechanical fastener openings through the side walls;

(iii) gasket sealing means disposed between the side walls and the back cover plate; and (iv) threaded mechanical fasteners extending through the mechanical fastener openings in the side walls and engaging the threaded holes in the back cover plate to compress the gasket sealing means between the side walls and the back cover plate for hermetic sealing of the enclosure assembly.

3. A hermetic enclosure assembly according to claim 1, wherein the transparent front panel is formed of a material which substantially attenuates UV radiation exteriorly incident thereon.

4. A hermetic enclosure assembly according to claim 1, wherein the mounting base comprises a layer of gas-pervious, substantially acid-free cellulosic mounting stock having a front main surface for mounting of an object thereon and a rear surface which is secured to a rigid plate of gas-impervious material having first and second passage openings therein for gas communication with the interior volume of the enclosure assembly.

5. A hermetic enclosure assembly according to claim 4, wherein the means for securing the mounting base in the interior volume comprise means for securing the rigid plate of the mounting base to the back cover plate, including:

(i) mechanical fastener openings through the back cover plate;

(ii) threaded cavities in the rigid plate of the mounting base; and (iii) mechanical fasteners adapted to pass through the mechanical fastener openings in the back cover plate and engage the threaded cavities in the rigid plate of the mounting base.

6. A hermetic enclosure assembly according to claim 1, wherein the ports and valves of the back cover plate are gasketed with gasket compression sealing members to maintain hermetic sealing of the hermetic enclosure assembly.

7. A hermetic enclosure assembly according to claim 5, wherein the ports, valves, and mechanical fastener openings of the back cover plate are gasketed with gasket sealing members to maintain hermetic sealing of the hermetic enclosure assembly.

8. A hermetic enclosure assembly according to claim 1, wherein the means for visually indicating the presence of oxygen in the interior volume of the enclosure assembly comprises an electric light bulb including a first filament in an evacuated gas-tight envelope, and a second, corresponding filament in gas communication with the interior volume of the enclosure assembly, wherein the two filaments are wired in series with leads extending exteriorly of the enclosure assembly for connection with an external power circuit means, and the first port includes a transparent port cover for visual observation of the two filaments, whereby current passed through the filaments from an external power circuit means will cause the second filament to light up in the presence of oxygen in the interior volume of the enclosure assembly, but in the absence of oxygen in the interior volume of the enclosure assembly, will cause the first filament to light up, while the second filament remains inactive.

9. A hermetic enclosure assembly according to claim 8, wherein the filaments comprise tungsten wires.

10. A hermetic enclosure assembly according to claim 1, wherein the vapor-release deacidification medium disposed in the second port of the back cover plate comprises hexamethylentetramine crystals.

11. A hermetic enclosure assembly according to claim 10, wherein the hexamethyl-entetramine crystals are provided in an amount to insure the maintenance in the interior volume of the enclosure assembly of substantially neutral pH conditions.

12. A hermetic enclosure assembly according to claim 10, wherein the hexamethyl-entetramine crystals are retained in position in the port by a mesh retaining member disposed between the back cover plate and the rigid plate of the mounting base, and in registry with the second port and the second passage opening.

13. A hermetic enclosure assembly according to claim 1, wherein the mounting base includes a layer of gas-pervious, substantially acid-free cellulosic mounting stock comprising a laminate of (i) multi-ply, acid-free, archival quality, museum rag board, and (ii) single- or double-wall, acid-free, archival quality corrugated cardboard.

14. A hermetic enclosure assembly according to claim 4, wherein the rigid plate of the mounting base is formed of a metal material of construction.

15. A hermetic enclosure assembly according to claim 1, wherein the gas-impervious housing and the back cover plate are formed of a transparent polymeric material of construction.

16. A hermetic enclosure assembly according to claim 1, wherein the means for hermetically sealing the rearward portions of the side walls to the flush-mounted back cover plate do not comprise flexible sealing tape.

17. A hermetic enclosure assembly according to claim 1, wherein the interior volume contains a gas substantially free of oxygen.

18. A hermetic enclosure assembly according to claim 1, wherein the interior volume contains an inert gas.

19. A hermetic enclosure assembly according to claim 1, further comprising a cellulosic object mounted on the front main surface of the mounting base.

20. A method of preservationally and protectively enclosing an object for storage and/or display, comprising the steps of:

(I) providing unassembled enclosure components comprising:

(a) a gas-impervious housing including a transparent front panel for viewing of an enclosed object, and side walls extending (i) rearwardly from the front panel and (ii) continuously about the perimeter of the front panel, the side walls at their rearward portions being interiorly recessed to accommodate flush-mounting of a back cover plate at the rearmost extremity of the side walls;

(b) a mounting base having a front main surface for mounting of the object thereon and a rear main surface, said mounting base permitting gas communication with an interior volume of the enclosure assembly bounded by the front panel, the front main surface of the mounting base, and associated portions of the side walls, with the mounting base being of a size and shape to fit interiorly of the housing;

(c) a back cover plate flush-mountably engageable with the interior recess portion of the side walls, having first and second ports therein, and having selectively openable input and output valves therein for ingress of gas into the interior volume of the enclosure assembly and egress of gas therefrom, respectively;

(d) means for securing the mounting base in the interior volume;

(e) means for hermetically sealing the rearward portions of the side walls to the flush-mounted back cover plate;

(f) means for visually indicating the presence of oxygen in the interior volume of the enclosure assembly, disposed in the first port of the back cover plate; and (g) a vapor-release deacidification medium disposed in the second port of the back cover plate and arranged for dispersing deacidification medium vapor into the interior volume of the enclosure assembly;

(II) mounting the object on the front main surface of the mounting base;

(III) assembling the components (a)–(g) to form the enclosure assembly;

(IV) opening the input and output valves in the back cover plate;

(V) mixing an inert gas with a vapor-phase deacidification component to form a multicomponent fill gas mixture;

(VI) flowing the multicomponent fill gas mixture through the input valve into the enclosure assembly to displace air and moisture therefrom through the output valve, for purging of the interior volume of the enclosure assembly; and (VII) closing the input and output valves.

* * * * *

UNITED STATES PATENT AND TRADEMARK OFFICE

CERTIFICATE OF CORRECTION

PATENT NO. : 5,238,648

DATED : August 24, 1993

INVENTOR(S) : Irwin Kremen

It is certified that error appears in the above-identified patent and that said Letters Patent is hereby corrected as shown below:

Column 4, line 49: Change "previous" to -- pervious --.

Column 7, line 12: Change "from" to -- front --.

Signed and Sealed this

Twenty-first Day of June, 1994

*Attest:*

Bruce Lehman

BRUCE LEHMAN

*Attesting Officer*

*Commissioner of Patents and Trademarks*